US009628905B2

(12) United States Patent
Elko et al.

(10) Patent No.: US 9,628,905 B2
(45) Date of Patent: Apr. 18, 2017

(54) ADAPTIVE BEAMFORMING FOR EIGENBEAMFORMING MICROPHONE ARRAYS

(71) Applicant: MH Acoustics, LLC, Summit, NJ (US)
(72) Inventors: Gary W. Elko, Summit, NJ (US); Jens M. Meyer, Fairfax, VT (US)
(73) Assignee: MH Acoustics, LLC, Summit, NJ (US)

( * ) Notice: Subject to any disclaimer, the term of this patent is extended or adjusted under 35 U.S.C. 154(b) by 0 days.

(21) Appl. No.: 14/425,383
(22) PCT Filed: Jul. 15, 2014
(86) PCT No.: PCT/US2014/046607
§ 371 (c)(1),
(2) Date: Mar. 3, 2015
(87) PCT Pub. No.: WO2015/013058
PCT Pub. Date: Jan. 29, 2015

(65) Prior Publication Data

US 2016/0219365 A1 Jul. 28, 2016

Related U.S. Application Data

(60) Provisional application No. 61/857,820, filed on Jul. 24, 2013, provisional application No. 61/939,777, filed on Feb. 14, 2014.

(51) Int. Cl.
*H04R 1/32* (2006.01)
*H04R 3/00* (2006.01)
*H04R 3/04* (2006.01)

(52) U.S. Cl.
CPC ..... *H04R 1/326* (2013.01); *H04R 3/005* (2013.01); *H04R 3/04* (2013.01);
(Continued)

(58) Field of Classification Search
CPC ..... H04R 1/326; H04R 3/005; H04R 3/04; H04R 2201/401; H04R 2430/23; H04S 2400/15
See application file for complete search history.

(56) References Cited

U.S. PATENT DOCUMENTS

2002/0054634 A1* 5/2002 Martin ..... H04L 25/03057 375/232
2003/0147539 A1* 8/2003 Elko ..... H04R 3/005 381/92

(Continued)

FOREIGN PATENT DOCUMENTS

WO WO2015013058 A1 1/2015

OTHER PUBLICATIONS

Benesty et al., "Sparse Adaptive Filters", 2006, Springer, pp. 59-84.*

(Continued)

*Primary Examiner* — Sonia Gay
(74) *Attorney, Agent, or Firm* — Mendelsohn Dunleavy, P.C.; Steve Mendelsohn

(57) ABSTRACT

An exemplary audio signal processing system includes a modal decomposer and an adaptive modal beamformer. The modal decomposer generates a plurality of zeroth-order eigenbeams from audio signals from an (e.g., spherical) array of audio sensors. The adaptive modal beamformer (i) steers the zeroth-order eigenbeams to a specified direction, (ii) adaptively generates a plurality of weighting coefficients for the plurality of zeroth-order eigenbeams, where the plurality of weighting coefficients satisfy a constraint of having only non-negative values, (iii) respectively applies the plurality of adaptively generated weighting coefficients to the plurality of steered, zeroth-order eigenbeams to generate a plurality of weighted, steered, zeroth-order eigenbeams, and (iv) combines the plurality of weighted, steered, zeroth-order eigenbeams to generate an output audio signal. Some embodiments have a further constraint that the weighting coefficients sum to a specified value (e.g., one).

21 Claims, 4 Drawing Sheets

(52) U.S. Cl.
CPC .... *H04R 2201/401* (2013.01); *H04R 2430/23* (2013.01); *H04S 2400/15* (2013.01)

(56) References Cited

U.S. PATENT DOCUMENTS

2010/0202628 A1* 8/2010 Meyer ..... H04R 1/406 381/92
2012/0093344 A1 4/2012 Sun et al.

OTHER PUBLICATIONS

Kivenen et al., Exponentiated Gradient Versus Gradient Descent for Linear Predictors, 1994, p. 11-13.*
International Search Report and Written Opinion; Mailed Oct. 13, 2014 for the corresponding PCT Application No. PCT/US2014/046607.
Frost, O., "An Algorithm for Linearly Constrained Adaptive Array Processing," Proceedings of the IEEE, vol. 60, No. 8, Aug. 1972, pp. 926-935.
Sondhi, M. M., et al., "Adaptive Optimization of Microphone Arrays Under a Nonlinear Constraint," ICASSP 86, Tokyo, pp. 981-984.
Meyer, J., et al., "A Highly Scalable Spherical Microphone Array Based on an Orthonormal Decomposition of the Soundfield," 2002 IEEE, pp. II-1781 to II-1784.
"Audio Signal Processing for Telecollaboration in the Next-Generation Multimedia Communication," Edited by Huang, et al., Bell Laboratories, Lucent Technologies, pp. Title-29.
Kogon, S. M., "Eigenvectors, Diagonal Loading and White Noise Gain Constraints for Robust Adaptive Beamforming," Conference Record of the 37th Asilomar Conference on Signals, Systems, & Computers, Pacific Groove, CA, Nov. 9-12, 2003, New York, NY, IEEE, US, vol. 2, pp. 1853-1857.
Rafaely, B., "Spherical Microphone Array with Multiple Nulls for Analysis of Directional Room Impulse Responses," IEEE 2008, pp. 281-284.
Van Trees, H., "Optimum Array Processing: Chapter 7—Adaptive Beamformers" Part IV of Detection, Estimation, and Modulation Theory, Apr. 4, 2002, 6 pages.
Chin, T. Y., et al., "A 25-GHz Compact Low-Power Phased-Array Receiver with Continuous Beam Steering in CMOS Technology," IEEE Journal of Solid-State Circuits, IEEE Service Center, Piscataway, NJ, USA, vol. 45, No. 11, Nov. 1, 2010, pp. 2273-2282.
Elko, G. W., et al., "Adaptive Beamformer for Spherical Eignbeamforming Microphone Arrays," 2014 4th Joint Workshop on Hands-Free Speech Communication and Microphone Arrays, IEEE, May 12, 2014, pp. 52-56.
Meyer, J., et al., "Spherical Microphone Array for Spatial Sound Recording," Audio Engineering Society convention Paper, New York, NY, US, Oct. 10, 2003, pp. 1-9.

* cited by examiner

ADAPTIVE BEAMFORMING FOR EIGENBEAMFORMING MICROPHONE ARRAYS

CROSS-REFERENCE TO RELATED APPLICATIONS

This application claims the benefit of the filing date of U.S. provisional application Nos. 61/857,820, filed on Jul. 24, 2013, and 61/939,777, filed on Feb. 14, 2014, the teachings of both of which are incorporated herein by reference in their entirety.

BACKGROUND

Field of the Invention

The present invention relates to audio signal processing and, more specifically but not exclusively, to beamforming for spherical eigenbeamforming microphone arrays.

Description of the Related Art

This section introduces aspects that may help facilitate a better understanding of the invention. Accordingly, the statements of this section are to be read in this light and are not to be understood as admissions about what is prior art or what is not prior art.

Spherical microphone arrays have become a subject of interest in recent years [Refs. 1-4]. Compared to "conventional" arrays or single microphones, they provide the following advantages: steerable in 3-D space, arbitrary beampattern (within physical limits), independent control of beampattern and steering direction, easy beampattern design due to orthonormal "building blocks," compact size, and low computational complexity. With these characteristics, it is appealing to a wide variety of applications such as music and film recording, wave-field synthesis recording, audio conferencing, surveillance, and architectural acoustics measurements.

U.S. Pat. Nos. 7,587,054 and 8,433,075 describe spherical microphone arrays that use a spherical harmonic decomposition of the acoustic sound field to decompose the sound field into a set of orthogonal eigenbeams [Refs. 3-4]. These eigenbeams are the orthonormal "building blocks" that are then combined in a weight-and-sum fashion to realize any general beamformer up to the maximum degree of the spherical harmonic (SH) decomposition.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Figure 1:
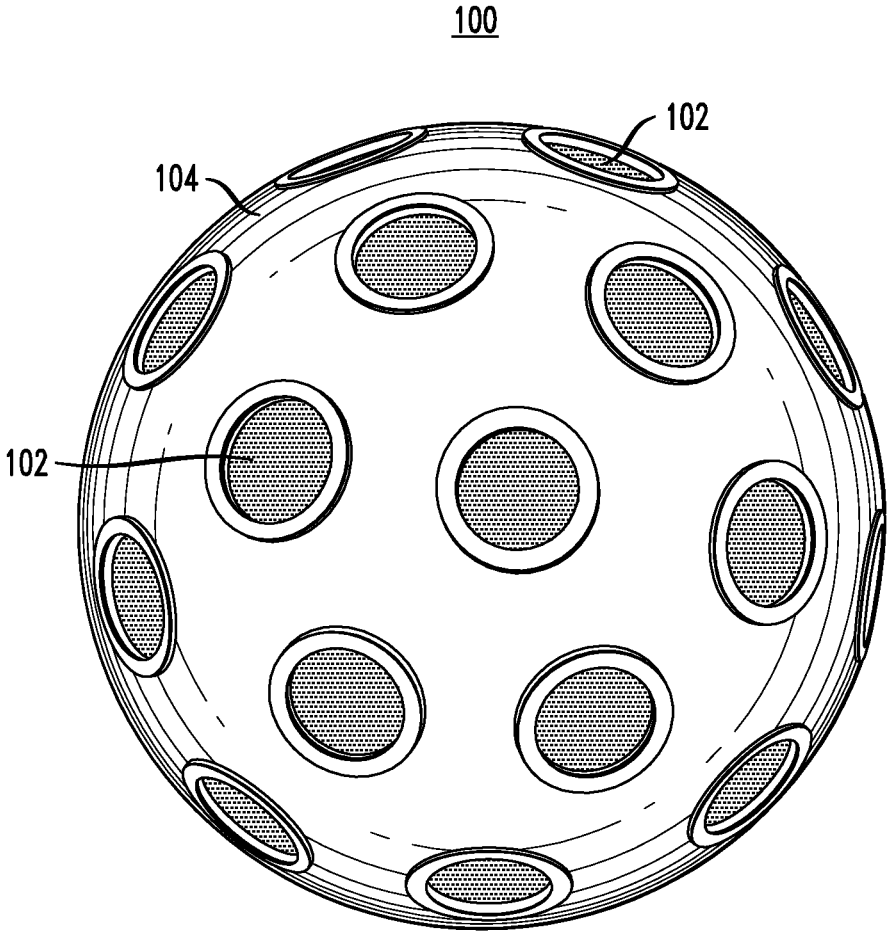
FIG. 1 shows a schematic diagram of an exemplary spherical microphone array.

FIG. 1 shows a schematic diagram of an exemplary spherical microphone array 100 comprising 32 audio sensors

102 mounted on the surface of an acoustically rigid sphere 104 in a "truncated icosahedron" pattern. Each audio sensor 102 generates a time-varying analog or digital (depending on the implementation) audio signal corresponding to the sound incident at the location of that sensor.

Figure 2:
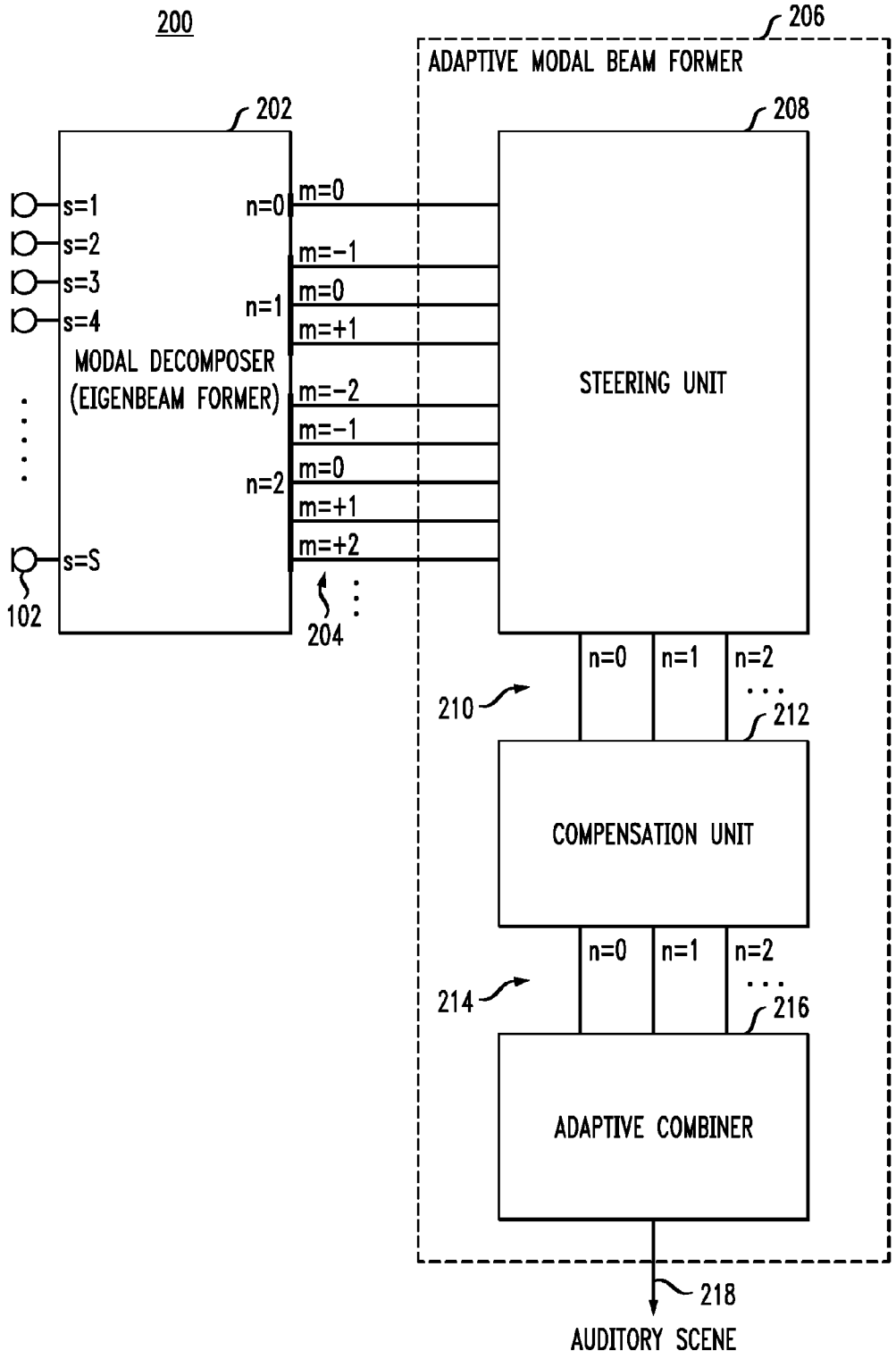
FIG. 2 shows a block diagram of an exemplary adaptive audio system for processing audio signals.

FIG. 2 shows a block diagram of an exemplary adaptive audio system 200 for processing S audio signals, such as the audio signals generated by the S=32 audio sensors 102 of FIG. 1 and transmitted to audio system 200 via some suitable (e.g., wired or wireless) connection, to generate one or more audio output signals 218. As shown in FIG. 2, system 200 comprises modal decomposer (i.e., eigenbeam former) 202 and adaptive modal beamformer 206.

Modal decomposer 202 decomposes the S different audio signals to generate a set of time-varying, spherical-harmonic (SH) outputs 204, where each SH output corresponds to a different eigenbeam for the microphone array. FIG. 2 explicitly indicates the one eigenbeam of degree n=0, the three eigenbeams of degree n=1, and the five eigenbeams of degree n=2. As indicated in the figure by the ellipsis, modal decomposer 202 may also generate SH outputs for eigenbeams of higher degree (such as the seven eigenbeams of degree n=3) depending on the number S of audio sensors in the array.

Modal beamformer 206 receives the different SH outputs 204 generated by modal decomposer 202 and generates an audio output signal 218 corresponding to a particular look direction of the microphone array. Depending on the application, multiple instances of modal beamformer 206 may simultaneously and independently generate multiple output signals corresponding to two or more different look directions of the microphone array or different beampatterns for the same look direction.

Figure 3:
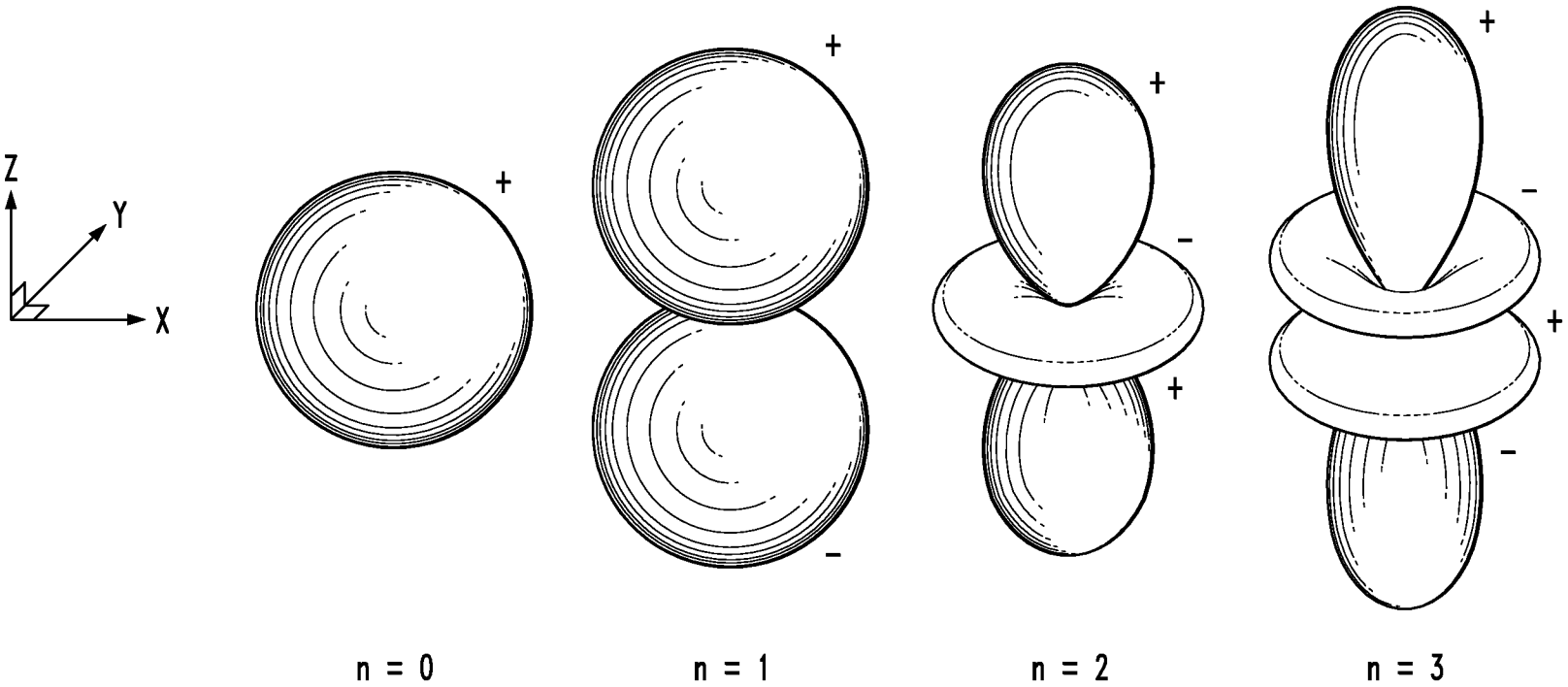
FIG. 3 shows beampatterns representing the spatial responses of the (unrotated) zeroth-order spherical-harmonic eigenbeams for the first four degrees.

FIG. 3 shows beampatterns representing the spatial responses of the (unrotated) zeroth-order eigenbeams for the first four degrees n=0 through n=3. Note that all zeroth-order eigenbeams are positive in the direction of the positive Z-axis and are rotationally symmetric about the Z-axis. The representations indicate the positive and negative phases of the spherical harmonics relative to the acoustic phase of an incident sound wave.

Modal beamformer 206 exploits the geometry of the spherical microphone array 100 of FIG. 1 and relies on the spherical harmonic decomposition of the incoming sound field by modal decomposer 202 to construct a desired spatial response. Modal beamformer 206 can provide continuous steering of the beampattern in 3-D space by changing a few scalar multipliers, while the filters determining the beampattern itself remain constant. The shape of the beampattern is invariant with respect to the steering direction. Instead of using a filter for each audio sensor as in a conventional filter-and-sum beamformer, modal beamformer 206 needs only one filter per spherical harmonic, which can significantly reduce the computational cost.

Adaptive audio system 200 of FIG. 2 with the spherical geometry of microphone array 100 of FIG. 1 enables accurate control over the beampattern in 3-D space. In addition to pencil-like beams, system 200 can also provide multi-direction beampatterns or toroidal beampatterns giving uniform directivity in one plane. These properties can be useful for applications such as general multichannel speech pick-up, video conferencing, or direction of arrival (DOA) estimation. It can also be used as an analysis tool for room acoustics to measure directional properties of the sound field.

Adaptive audio system 200 offers another advantage: it supports decomposition of the sound field into mutually orthogonal components, the eigenbeams (e.g., spherical harmonics) that can be used to reproduce the sound field. The eigenbeams are also suitable for wave field synthesis (WFS) and higher-order Ambisonics (HOA) methods that enable spatially accurate sound reproduction in a fairly large volume, allowing reproduction of the sound field that is present around the recording sphere. This allows all kinds of general real-time spatial audio applications.

As shown in FIG. 2, modal beamformer 206 comprises steering unit 208, compensation unit 212, and adaptive combiner 216. In one possible implementation, steering unit 208 receives the SH outputs 204 from modal decomposer 202, steers only the zeroth-order eigenbeams to a desired look direction, and outputs SH outputs 210 corresponding to those steered, zeroth-order eigenbeams. Compensation unit 212 applies frequency-response corrections to the steered SH outputs 210 to generate corrected, steered SH outputs 214 for the steered, zeroth-order eigenbeams. Adaptive combiner 216 combines the different, corrected, steered SH outputs 214 to generate the system output(s) 218. Note that SH outputs 210 and 214 for only the first three zeroth-order eigenbeams are explicitly represented in FIG. 2, but that SH outputs for the zeroth-order eigenbeams for higher degrees (i.e., third or higher) may also be part of the signal processing of modal beamformer 206.

Those skilled in the art will understand that, in other implementations, in addition to the zeroth-order eigenbeams, one or more of the non-zeroth-order eigenbeams can also be steered, frequency-compensated, weighted, and summed to generate the output audio signal 218.

Past papers and issued patents have shown an efficient implementation of spherical array beamformers that can be attained by splitting the beamformer into the two stages 202 and 206 of FIG. 2 [Refs. 1-4]. The first, modal decomposer stage 202 decomposes the soundfield into spatially orthonormal components, while the second, modal beamformer stage 206 combines these components as eigenbeam spatial building blocks to generate a designed output beam 218 or multiple simultaneous desired output beams. For a spherical array, such as array 100 of FIG. 1, these building blocks are spherical harmonics $Y_n^m$ (204 in FIG. 2) that are defined according to Equation (1) as follows:

$$Y_n^m(\vartheta, \varphi) \equiv \sqrt{\frac{(2n+1)}{4\pi}\frac{(n-m)!}{(n+m)!}}\, P_n^m(\cos\vartheta)e^{im\varphi} \tag{1}$$

where $P_n^m$ represents the associated Legendre functions of degree n and order m, and [θ,ϕ] are the standard spherical coordinate angles [Ref. 1].

Note that Equation (1) describes the complex version of the spherical harmonics. A real-valued form of the spherical harmonics can also be derived and is widely found in the literature. The real-valued definition is useful for a time-domain implementation of the adaptive beamforming audio system. Most of the specifications in this document will use a frequency-domain representation. However, those skilled in the art can easily derive the time-domain equivalent.

In order to demonstrate how the spatial spherical harmonics are extracted from the soundfield, we start with Equation (2) for the sound pressure p at a point $[\alpha,\theta_s,\phi_s,]$ on the surface of an acoustically rigid sphere located at the origin of a spherical coordinate system for a plane wave incident from direction [θ,ϕ] as follows:

$$p(a, \vartheta_s, \varphi_s) = 4\pi \sum_{n=0}^{\infty} i^n b_n(ka) \sum_{m=-n}^{n} Y_n^m(\vartheta, \varphi) Y_n^{m*}(\vartheta_s, \varphi_s) \tag{2}$$

where the impinging plane wave is assumed to have unity magnitude, α is the radius of the sphere, k is the wavenumber, and $b_n(k\alpha)$ is the frequency response of degree n and is defined as follows:

$$b_n(k\alpha) = i[(k\alpha)^2 h_n'(k\alpha)]^{-1} \tag{3}$$

where the prime indicates a derivative of the Hankel function h with respect to the function argument. Note that the mathematical naming convention for spherical Hankel functions is inconsistent with the standard convention for the associated Legendre function with regards to defining how the function is described. In standard literature, the spherical Hankel function nomenclature is to denote the functional integer as "order" and not "degree" for the subscript dimension. In order to have consistent terminology, the spherical Hankel function subscript will be referred herein as "degree" and not the standard "order".

Assume that there is an acoustic pressure sensitive surface on the sphere where the sensitivity can be described by a spherical harmonic $Y_n^m(\theta,\phi)$. The frequency-domain outputs $y_{nm}$ of such a spherical microphone can be written according to Equation (4) as follows:

$$\begin{aligned} y_{nm}(ka, \vartheta, \varphi) &= \frac{1}{4\pi}\int_{\Omega_s} p(ka, \vartheta_s, \varphi_s) Y_n^m(\vartheta_s, \varphi_s)\, d(\Omega_s \\ &= i^n b_n(ka) Y_n^m(\vartheta, \varphi) \end{aligned} \tag{4}$$

Equation (4) is an intuitively elegant result in that it explicitly shows that the directivity pattern of an eigenbeam from the spherical microphone is equal to its surface acoustic sensitivity weighting by the same spherical harmonic that represents the associated eigenbeam. This result is the spatial equivalent of the use of orthonormal eigenfunction expansion that is fundamental in the analysis of linear systems. The frequency response of the output signal corresponds to the modal response $b_n$.

In order to provide frequency-independent building blocks to the modal beamformer stage 206, the modal decomposer stage 202 needs to equalize the eigenbeam responses 204. This is discussed in more detail in [Ref. 1] and in the next section. In practice, it is not practical to use a continuous surface sensitivity since this would allow only a single beam of one specific degree and order to be extracted or designed. A more-flexible implementation can be obtained by sampling the surface at a discrete set of locations. The number and location of these sample points depend on the maximum spherical harmonic degree and order that needs to be extracted. In certain embodiments, the selected sensor locations satisfy what is referred to as the "discrete orthonormality" condition [Ref. 1]. The exemplary array implementation shown in FIG. 1 and analyzed herein is based on using truncated icosahedron geometry with the 32 sensors located at the center of the faces of this irregular polyhedron. Other sensor locations that fulfill or approximately fulfill the discrete orthonormality condition are also valid. One technique that could be used to enforce discrete orthonormality is to use quadrature coefficients in the discrete summation of the products of the various discretely sampled spherical harmonics by the chosen microphone locations on the spherical surface. These additional quadrature multiplication factors in the discrete summation are chosen to enforce orthonormality of the sampled eigenbeams up to a desired degree.

In one possible frequency-domain implementation for the 32-sensor array 100 of FIG. 1, frequency-domain eigenbeam signals $y_{nm}(f)$ (204 in FIG. 2) are generated using a discretized, frequency-domain version of Equation (4) as follows:

$$y_{nm}(f) = \frac{4\pi}{S}\sum_{s=0}^{S-1} p_s(f) Y_n^m(\vartheta_s, \varphi_s) \tag{5}$$

where $p_s(f)$ represents the frequency-domain output signal of the s-th sensor, and $Y_n^m(\theta_s,\phi_s)$ represents the value of the spherical harmonic of degree n and order m at the location of the s-th sensor $(\theta_s,\phi_s)$. For the 32-sensor array 100, S has the value of 32.

Beampattern Control

An N-th degree general array output beampattern $x(\theta,\phi)$ is formed in the modal beamformer stage 206 of FIG. 2 by a linear combination of the components 204 derived in the modal decomposer stage 202. Note that, in certain embodiments, only the zeroth-order modes are used to design the output beampattern, while all of the SH modes are used for steering of the pattern in 3D space. Two factors that limit control of the beampattern are (i) spatial aliasing caused by discretely sampling the acoustic pressure on the surface of the sphere and (ii) the finite number of spherical harmonics that can be accurately extracted from the soundfield. The total number of microphones determines the second factor. In the limit, one could, in theory, differentiate between the total number of microphone elements; however, this is not typically the case since one has to deal with the problem of spatial aliasing due to using a discrete sampling of the spherical surface.

There are 2n+1 eigenbeams 204 per degree n. As mentioned above, all eigenbeams are used for steering the array in 3D space to maintain the beampattern shape while steering.

Many aliasing components are not problematic, but significant aliasing of the fourth-degree spherical harmonics by the sixth-degree modes can occur, and the third-degree spherical harmonics have strong aliasing by the seventh-degree eigenbeams. In order to ascertain how problematic these strongly aliased, higher-degree modes are for an overall design, the frequency response of the eigenbeams (as represented by Equation (4)) is also considered. Since the eigenbeams have high-pass responses equal in order with the degree of the sampled spherical harmonics, one can conclude that aliasing will not become a significant problem until the modal strengths become close. One way to handle this problem is to apply low-pass filters on the higher-degree eigenbeams so that the overall degree of the output beampattern is decreased commensurately as frequency increases.

Steering the Eigenbeams

After each zeroth-order eigenbeam is generated for the default, Z-axis look direction θ=0, it is relatively straightforward to steer the zeroth-order eigenbeams to some general spherical angle $(\theta_0,\phi_0)$. The steered, n-th degree, zeroth-order, frequency-domain output $y_n^s(f)$ (210 of FIG. 2) of steering unit 208 can be expressed as follows:

$$y_n^s(f) = \sum_{m=-n}^{n} \sqrt{\frac{4\pi}{2n+1}}\, Y_n^{m*}(\vartheta_0, \varphi_0) y_{nm}(f) \tag{7}$$

where $y_{nm}(f)$ represents the n-th degree, m-th order, frequency-domain eigenbeams 204 and $Y_n^{m*}(\theta_0,\phi_0)$ represents the complex conjugate of the n-th degree, m-th order spherical harmonic for the spherical angle $(\theta_0,\phi_0)$. Note that the superscript s indicates the steered eigenbeams. Equation (7) is written for frequency-domain signals. Equation (7) is based on the Spherical Harmonic Addition Theorem. However, since the equation involves scalar multiplication and addition, it can be modified for time-domain implementation by replacing the frequency-domain signals with their equivalent time-domain signals. It should be noted here that a general rotation of real and complex spherical harmonics could be accomplished by using the well-known Wigner D-matrices [Ref. 13].

Frequency Compensation

As described previously, after the zeroth-order eigenbeams are steered to the desired look direction by steering unit 208, compensation unit 212 applies frequency-response corrections to the steered, n-th degree, zeroth-order, frequency-domain eigenbeam $y_n^s(f)$ (210) as follows:

$$y_n^{sc}(f)=G(f)y_n^s(f) \tag{8}$$

where $y_n^{sc}(f)$ represents the resulting steered and frequency-compensated eigenbeam 214. Note the superscript sc indicates "steered and frequency-compensated" eigenbeam signals.

The filter G(f) can be derived from Equations (3) and (4) and represented as follows:

$$G(f) = \frac{1}{i^n b_n\left(\frac{2\pi f}{c}a\right)} \tag{9}$$

where a is the radius of the spherical array 100, and c is the speed of sound. A time-domain implementation of the filter can be derived and convolved with the time-domain eigenbeams 210 to get the time-domain version of the steered and compensated eigenbeams 214.

Linear and Cylindrical Array Eigenbeamforming

Although the above development was explicitly framed around spherical beamforming sensor arrays, the representation is also applicable to cylindrical (3D), circular and other elliptical (2D), and linear (1D) arrays. Due to the geometric sampling of the acoustic field by elliptical and linear arrays, there are some limitations due to the insufficient sampling of the 3D space by these other geometries. However, the basic principles still apply, and the eigenbeamformer approach is still valid and applicable with the caveat that not all spherical eigenbeams can be rendered by array geometries that do not span 3D space. For a fixed endfire linear array, the zero-order spherical harmonics can be realized along the axes of the linear array since the linear array spatial response can be written as a summation of Legendre polynomials with θ as the angle relative to the linear array axis. Similarly, an elliptical array spatial response can be written in terms of the summation of Legendre polynomials of varying degrees with the ability to rotate the steering angle θ in the plane of the array with the ability to separate the steering angle and the beampattern shape as in the spherical eigenbeamformer.

Although the different embodiments have been described in the context of spherical harmonics, those skilled in the art will understand that any separable coordinate system expansion can be used for different array geometries, although some coordinate systems are more suitable for certain geometries. For example, cylindrical harmonics in the parabolic cylinder coordinate system could be used for a cylindrical microphone array, circular harmonics could be used for a circular microphone array, a Legendre polynomial expansion could be used for a linear microphone array, and a 1D Fourier expansion could be used for a uniformly-spaced linear microphone array.

Adaptive Eigenbeamforming

Figure 4:
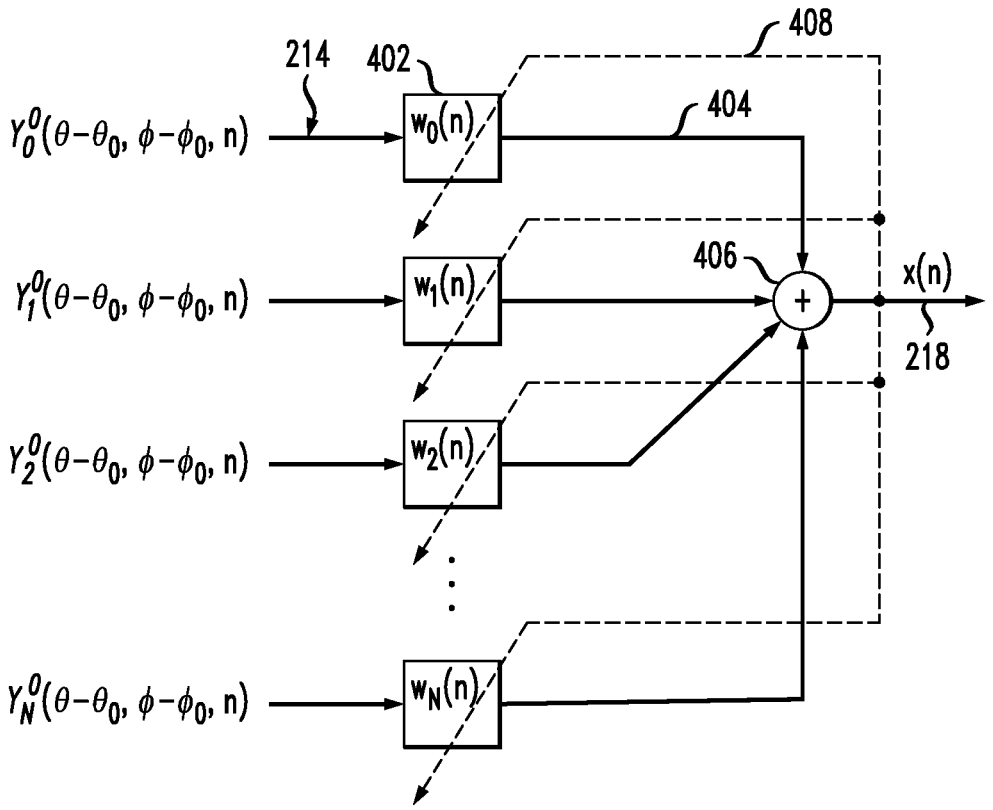
FIG. 4 shows a block diagram of the adaptive combiner of FIG. 2.

FIG. 4 shows a block diagram of adaptive combiner 216 of FIG. 2. As shown in FIG. 4, adaptive combiner 216 receives the spherical harmonics 214 for (N+1) zeroth-order eigenbeams corresponding to degrees 0 to N that have been steered to a desired look direction $\theta_0,\phi_0$ by steering unit 208 and frequency-compensated by compensation unit 212. Adaptive combiner 216 applies a corresponding weighting coefficient $w_i$ (n) to the i-th degree, zeroth-order eigenbeam 214 at a corresponding multiplication node 402 and sums the resulting weighted, zeroth-order eigenbeams 404 at summation node 406 to generate the audio output signal 218. As indicated in FIG. 4, the weighting coefficients are adaptively adjusted (408) to generate the desired output signal 218.

Beampattern design is realized by computing the weighting coefficients $w_i$ (n) that realize specific desired beamformers. For instance, one can compute the optimized weighting coefficients that result in the highest attainable directivity gain, which is called the hypercardioid beampattern. Another popular beampattern is the supercardioid that uses weighting coefficients to maximize the ratio of the output power from the front half-plane directions to the output power from the rear half-plane directions. There are other common beampatterns such as cardioid and dipole patterns that are also commonly found in use today. However, almost all commercial microphones are non-steerable, fixed, first-order differential designs.

Since real soundfields are almost never known a priori, using one of the standard beampatterns mentioned above will rarely result in an optimal design in terms of maximizing the output signal-to-noise ratio (SNR) of the beamformer. Researchers have addressed this shortcoming by developing many ways to realize a dynamic adaptive beamformer algorithm that allows the beamformer to "find" the optimal weighting coefficients using the only acoustic field that the beamformer currently "sees" and some prescribed constraints. There are many adaptive beamforming schemes that have been proposed in the past with the Minimum-Variance Distortionless Response (MVDR) being one of the most common [Ref. 5]. For SH beamformers, this approach has been suggested in [Refs. 6-8]. The solution given by Frost is probably the most well-known solution to the adaptive beamforming problem and can be implemented in a fairly computationally efficient manner. However, there are inherent problems with the Frost beamformer that can lead to poor performance in real-world applications. One major problem in the use of the Frost and other filter-sum adaptive beamformers is that their adaptation algorithms are sensitive to room reverberation, where reverberation is essentially coherent multipath. Having correlated reflections in the input correlation matrix can allow the beamformer to meet "look-direction" and other constraints yet result in high amounts of frequency-response distortion in the "look direction". There have been attempts to limit the "signal cancellation" frequency-response distortion problem by averaging over sub-arrays or limiting the tap depth in the filters that are used in the Frost beamformer [Refs. 9,10]. Due to its relatively simple structure of utilizing only four single-tap adaptive weights (and therefore no tap depth), the adaptive spherical harmonic eigenbeamformer significantly reduces the signal cancellation problem found in more-general adaptive filter-sum beamformers.

To begin, it is assumed that only axisymmetric beampatterns that are formed by combining zeroth-order eigenbeams are desired. This assumption greatly simplifies the adaptive beamforming implementation. Constraining the beampatterns to use only the zeroth-order eigenbeams does not really impact the overall performance of the beamformer. It is the highest degree of the beamformer that sets the maximum number of independent nulls that can be directed at noise-source directions and the maximum directional gain. Beamformers that use only the zeroth-order eigenbeams can attain any axisymmetric beampattern: from no directional gain to maximum diffuse directional gain and a full continuum in between. Even though we have restricted the beamformer to use only the zeroth-order eigenbeams, all the spherical harmonic components for a specific degree are used to steer the zeroth-order beampatterns (see Equation (6)). Thus, limiting the beamformer to only using zeroth-order eigenbeams does not compromise the desired spatial properties of the spherical harmonic approach.

It should be noted that it is possible to use all spherical harmonic orders if one first rotates the eigenbeam so that its main lob is pointing in the desired look direction. Using higher-order eigenbeams would allow the adaptive beamformer to also attain beampatterns that are not necessarily axis-symmetric. Using the higher-order harmonics to allow the adaptive beampattern to attain non-symmetric beampatterns is discussed later in more detail.

One adaptive algorithm becomes apparent when comparing all the zeroth-order eigenbeams. All zeroth-order beampatterns have a positive value (the ouput is in-phase with the incident sound wave relative to the phase-center of the spherical array) in the unsteered beamformer direction (i.e., all zeroth-order eigenbeams have a maximum in the positive Z-axis for the unsteered beamformer). With this observation, an appropriate adaptive beamformer would hinge on finding an algorithm that minimizes the total output power under the constraint that the sum of the zeroth-order beampatterns is a specified constant value for the desired look (steered) direction (for simplicity, this specified constant may be unity). By constraining the adaptive weights to be non-negative, an adaptive beamformer can minimize the output power while guaranteeing the maximum sensitivity for the "look direction." One known algorithm, the Exponentiated-Gradient (EG) algorithm inherently fulfills the positive weights as part of its basic operation. Similarly, least-mean-square (LMS) algorithm can also be utilized after adding the constraint of non-negative weights to the underlying LMS algorithm.

Note that, for odd degrees n=1, 3, etc., rotating the positive lobe of the corresponding zeroth-order eigenbeam to the look direction and constraining its weighting coefficient to be positive is equivalent to rotating the negative lobe of that same zeroth-order eigenbeam to the look direction and constraining its weighting coefficient to be negative. Any descriptions and recitations of the former should be understood to refer to both the former and the latter.

Similarly, constraining the adaptive weights to be non-negative and to sum to a specified, positive constant value differs from constraining the adaptive weights to be non-positive and to sum to a specified, negative constant value only by a sign inversion. Here, too, any descriptions and recitations of the former should be understood to refer to both the former and the latter.

Exponentiated-Gradient Algorithm

The Exponentiated-Gradient (EG) algorithm is a variant of the LMS algorithm. Kivinen and Warmuth proposed the algorithm in their now-seminal publication [Ref. 11]. In its standard form, the EG algorithm requires that all the weights be positive and sum to one. The EG algorithm is a gradient-descent-based algorithm where the adaptive weights are adjusted at each time step in the direction that minimizes the difference between the weighted sum of inputs and a desired output. For our case, we wish to minimize the total output power of the beamformer under the constraint that the sum of the zeroth-order eigenbeam weights is equal to one. Thus, we can assume that the desired output signal is zero, and the adaptive weights are adjusted in the direction to minimize the mean-square output. In equation form (using discrete time), $$x(n+1)=w(n)^T Y^{sc}(n) \tag{10}$$

where $$w(n)=[w_0(n)w_1(n)\ .\ .\ .\ w_{L-1}(n)]^T \tag{11}$$

and $$Y^{sc}(n)=[y^{sc}{}_0(n)y^{sc}{}_1(n)y^{sc}{}_2(n)\ .\ .\ .\ y_N{}^{sc}(n)]^T \tag{12}$$

where the weights vector w(n) defines the current set of adaptive weights $w_i(n)$ for the L sensors, and the data vector x(n+1) contains the most-recent output eigenbeam samples. To minimize the output in a least-mean-squares sense, the EG algorithm update adjusts the weights to a new set of updated weights according to Equation (13) as follows:

$$w_l(n+1)=\frac{w_l(n)r_l(n+1)}{\sum_{j=0}^{L-1} w_j(n)r_j(n+1)} \tag{13}$$

where the subscript l is the combination weight of the l-th eigenbeam output signal, and $$r_l(n+1)=\exp[-2\eta y_l^{sc}(n+1)\times(n+1)] \tag{14}$$

where the scale factor η was termed the "learning rate" by Kivinen and Warmuth and is analogous to the adaptive step-size used in the LMS and NLMS algorithms [Ref. 8]. For the em32 Eigenmike® microphone array from mh acoustics of Summit, N.J., the current maximum eigenbeam degree is third degree and therefore L=4.

Benesty and Huang have shown that one can also normalize the EG algorithm in a similar fashion as normalizing the LMS algorithm to remove the impact of nonstationary input signals [Ref. 12]. Using NLMS-style normalization essentially replaces the step-size factor by one that is normalized by a factor that is proportional to the input power. This computation is also typically regularized so that the computed normalization cannot be zero (to avoid a division by zero). Thus, Equation (14) becomes the following Equation (15):

$$r_l(n+1)=\exp[-Lu(n+1)y_l^{sc}(n+1-1)\times(n+1)] \tag{15}$$

where, $$u(n+1)=\frac{\alpha}{Y^{sc}(n+1)^T Y^{sc}(n+1)+\delta} \tag{16}$$

The factor α is a scalar step-size control value, and the limiting minimum value of the denominator is δ (since the first term in the denominator has a minimum of zero). One can also use a smoothed estimate of the input power in the denominator, e.g., by using a smoothed estimate of the power envelopes of all the eigenbeams. The sum of these eigenbeam output powers has been used with good results in simulations. Other functions that return some approximation of the eigenbeam energy estimate of the eigenbeam outputs could alternatively be used.

There are many other possible adaptive algorithms that could also be used including the NLMS algorithm itself. The constraints that the summation of the weights is unity and all weights are positive give the EG algorithm a preference from a simplicity of implementation perspective. With this approach, third-degree adaptive eigenbeam processing requires only four adaptive scalar weights per frequency band. The EG algorithm's often-stated advantage is a higher convergence speed with systems that have sparse tap weight distributions. This is not the main benefit of the EG algorithm here.

Although the EG adaptive beamformer does not explicitly include a White-Noise-Gain (WNG) constraint on the beamformer output, one can impose this constraint by introducing independent noise to the input channels before the adaptive beamformer. (Note that the additional noise is injected into a separate background adaptive processing unit and not into the actual spherical array beamformer signal that is formed without the addition of noise. The weights from the background noise-added adaptive beamformer are then copied to the main output beamformer channel which does not have any noise injected into the processing stages.) The noise can be "shaped" to achieve a frequency-dependent WNG. For example, the noise can be shaped according to $1/b_n$ or some other noise shape. One could, for instance, tailor the noise spectrum to incorporate certain properties of human perception in the optimization. As the EG algorithm is minimizing the output power, if the WNG values become too small, then the added independent noise will not allow the weighting coefficients to converge to beampatterns that have poor WNG. The net effect will be to gradually reduce the weighting of the higher-degree eigenbeams' low-frequency components that have higher sensitivity to independent noise on the sensor outputs (which is also the case when wind-noise is present on the microphone signals).

Since all non-zero order eigenbeams have output noise that is low-pass in nature, where the growth in noise is larger for the higher-degree eigenbeams at lower frequencies, it would be preferable to realize the eigenbeamformer either in frequency bands or completely in the frequency domain. However, since processing delay is sometimes important, especially in live broadcast, videoconferencing, or public address systems, the adaptive em32 Eigenmike® array has been implemented in a set of three overlapping bandpass filters. These bandpass filters effectively limit the maximum eigenbeam degree for each band while limiting the lower bound on the WNG of the beamformer. To realize the EG algorithm for the em32 Eigenmike® array, separate adaptive beamformers for each of the frequency ranges defined by the native bandpass filter design would be used. For applications where delay is not as important, a full frequency-domain implementation is preferred since it offers more degrees of freedom by allowing the adaptive beampattern to be independent for each frequency bin in the frequency domain.

Modified LMS Algorithm

The least-mean-square (LMS) algorithm uses a stochastic gradient approach to compute updates to the adaptive weights so that the average direction of the computed instantaneous gradient moves the weights in a direction to minimize the mean-square output power. The basic update equation is given by Equation (17) as follows:

$$w(n+1)=w(n)-2\mu Y^{sc}(n)\times(n) \tag{17}$$

where the step-size μ parameter controls the convergence rate. In order to make the convergence rate independent of the input power, the LMS is typically normalized (NLMS) by the input power according to Equation (18) as follows:

$$w(n+1)=w(n)-\frac{2\mu Y^{sc}(n)x(n)}{\langle Y^{sc}(n)^T Y^{sc}(n)\rangle+\delta} \tag{18}$$

where the brackets indicate a function that forms some averaging since normalizing by the sum of the instantaneous powers is not effective when there is no tap depth in the adaptive filter (here we have only a single tap). The regularization parameter δ limits the denominator so that extremely small input signals do not impact adaptation. Equation (18) has the same form as the normalized adaptation as shown in Equation (16). As mentioned previously, the LMS and NLMS algorithms need to be modified to implement the constraint that all weights need to be positive and sum to unity. Therefore, the modified update equation for the NLMS algorithm becomes Equation (19) as follows:

$$w(n+1)=w(n)-\frac{2\mu Y^{sc}(n)x(n)}{\langle Y^{sc}(n)^T Y^{sc}(n)\rangle+\delta} \tag{19}$$

$$w(l,n+1)=0 \text{ if } w(l,n+1)<0\forall l$$

where l is the l-th order weight, and then is renormalized as:

$$\tilde{w}(n+1)=\frac{w(n+1)}{w^T(n+1)1_{N+1}}.$$

Extensions to Nonsymmetric Adaptive Beampatterns

The previous discussion has been based on limiting the adaptive beamformer algorithm to use only the axisymmetric zeroth-order spherical harmonics beams. The initial assumption of limiting the use to only zeroth-order eigenbeams allowed for a straightforward presentation of an adaptive N-th degree SH beamformer with an axisymmetric response and N degrees of independent null angles relative to the beampattern steering direction. It was argued that this limitation was in fact not that much of a limitation since the maximum directivity index of the axisymmetric beamformer is still the maximum that is obtainable using all spherical harmonics in a general SH beamformer. However, there may be cases in non-diffuse fields where an asymmetric beampattern could yield better output SNR than an axisymmetric beamformer design. It is relatively straightforward to extend the previous results to include the higher-order SH components into the algorithm and thereby allow the adaptive beamformer to attain a more-general set of non-axisymmetric beampatterns. Asymmetric beampatterns have null locations that can be confined to specific directions in both spherical coordinate angles (and not just symmetric null "cones" relative to the steering direction).

Positive and negative higher-order components allow the beamformer to attain asymmetric beampatterns. In order to use these higher-order components in the constrained adaptive beamformer algorithm presented earlier, they would be steered to the desired beam direction. For simplicity, first assume that the desired source direction is in the positive Z-direction where the zeroth-order beams (center column) all have maximum values. The first-degree beampatterns are not usable since rotating these SH to the positive z-direction just duplicates the zeroth-order, first-degree SH beampattern. Degrees higher than first do not have this issue since they also have higher-orders that break the rotational symmetry issue that exists in the first-degree spherical harmonics. The negative and positive orders have a 90-degree rotation relative to each other since they are defined by the sine and cosine of the order number times the azimuthal spherical angle.

SH beampatterns also have maximum responses with a negative response. Negative spherical harmonic components can be used if they are combined in the summation by first multiplying these components by a minus one to flip the signal phase. It would be preferable to combine the steered maximum spatial higher-order SH responses in the adaptive summation, although precise steering to the desired direction is not required.

A second method to form nonsymmetrical beampatterns can be realized by using a combination of the zeroth-order SHs to form a symmetric adaptive beamformer followed by a second adaptive beamformer that uses only the non-zeroth-order (aka higher-order) SH eigenbeams. All non-zero order SH components (rotated to the desired source direction) have, by default, a null (or spatial zero) towards the steered direction. Higher-order SHs having a null in the desired direction is an advantageous property since these higher-order SHs can be used unmodified as the inputs to a "generalized sidelobe canceler" (GSC) adaptive beamformer. The preferred embodiment would be to perform a first adaptive beamformer using the zeroth-order beampatterns up to the desired order (as described in the section entitled Adaptive Eigenbeamforming) followed by a second GSC adaptive beamformer that adaptively subtracts from the zeroth-order symmetric adaptive beamformer to minimize the output power. One could actually combine these two operations into one general adaptive beamformer.

One implementation issue when using the GSC adaptive beamformer is the possibility of the desired beam direction signal leaking into the null directions, potentially allowing for some cancellation of the desired signal. To combat this problem, the adaptive GSC weighting coefficients can be constrained to limit the maximum amount of cancellation. The GSC signal cancellation problem points to a possible advantage for the proposed non-negative weight, adaptive beamformer. The non-negative combination adaptive beamformer combines only the positive maximum outputs of rotated spherical harmonics (or phase-inverted negative, rotated spherical harmonics). The minimization performed by the combination under the normalized total sum of the weights does not require precise steering to the desired source since this approach is immune to signal leakage in the beampattern nulls.

Finally, it should be noted that, although the above development of the adaptive beamformer has been described using orthonormal eigenbeam output signals, the adaptive algorithm could also be implemented using non-orthonormal eigenbeam signals. In fact, the use of the higher-order rotated eigenbeam signals to realize non-axisymmetric beampatterns describe above utilizes individually rotated eigenbeams that break the orthonormality property of the spherical harmonic representation.

Summary

A robust adaptive beamformer for spherical eigenbeamforming microphone arrays has been proposed. The approach exploits the property that all zeroth-order spherical harmonics have a positive main lobe in the defined steering direction of the beamformer. An adaptive array can therefore be realized that will not allow any beamformer null to move close to the desired "look" direction by constraining all the modal beamformer weights to be non-negative. If the sum of the modal weights is also constrained to be unity, then the beamformer response in the "look" direction does not change for any of the infinite possible beamformers that can be realized under the constraint of positive weight combination.

Two adaptive algorithms were suggested and programmed. The first algorithm shown was the Exponentiated Gradient (EG) algorithm that inherently has the positive weight constraint built into the basic algorithm. The second algorithm presented was a variant of the Least-Mean-Square (LMS) where the positive weight constraint and renormalization is applied at each update of the weights. Both algorithms showed similar performance in the simulations that were done. There might be a preference for the EG algorithm from an implementation perspective since one does not have to constrain the weights on each update. However, this advantage is probably not that significant in the overall computations that are required for eigenbeamforming.

A more-general adaptive beamformer allowing for asymmetric beampatterns was also described. Two approaches were suggested: first where a maxima of the higher-order SH eigenbeams are steered towards the desired direction and then those steered SH eigenbeams are combined into the proposed unit-norm adaptive beamformer, and second, to use a second (or a single combined implementation) adaptive GSC beamformer exploiting the fundamental property that all higher-order SH components have a null in the desired direction (when the eigenbeamformer is steered to the desired direction).

Although the presentation was based on a 3D spherical harmonic field expansion, the results are also applicable to the 2D cylindrical and elliptic cylindrical cases as well as other spheroidal expansions such as the more general oblate and prolate coordinate systems.

It was shown that it is advantageous to realize the time-domain adaptive eigenbeamformer in multiple frequency bands since the WNG constraint can be better managed and the operation of the spherical harmonic beamformer is a strong function of frequency due to the underlying frequency dependence of the eigenbeams. At a minimum, the eigenbeamformer should probably be split into a number of bands greater than or equal to the maximum degree of the eigenbeamformer. The third-degree em32 Eigenmike® array would therefore be realized with a minimum of three bands. Of course, dividing the eigenbeamformer into more bands would increase the number of degrees of freedom that the eigenbeamformer would have to maximize the output SNR under the adaptive beamformer constraints. It would be possible to generalize the adaptive beamformer to have more taps for each eigenbeam (more than the single tap that was proposed above). Adding tap depth to the eigenbeamformer allows more degrees of freedom in the time-domain implementation. The tap weights should be constrained to maintain the unity gain aspect of the adaptive beamformer in the steering direction as well as the delay so that the modal beamformers remain time-aligned.

The most-general beamformer approach would be to implement the adaptive beamformer in the frequency domain. A frequency-domain implementation enables much finer control over the number of spherical harmonic components that are combined as a function of frequency in the beamformer. A frequency-domain implementation would however introduce more processing delay and computational resources depending on the actual filterbank implementation.

REFERENCES (INCORPORATED HEREIN BY REFERENCE IN THEIR ENTIRETY)

[1] J. Meyer and G. W. Elko, Spherical Microphone Arrays for 3D Sound Recording, Chapter 3 (pp. 67-90) in *Audio Signal Processing for Next Generation Multimedia Communication Systems*, Editors: Yiteng (Arden) Huang and Jacob Benesty, Kluwer Academic Publishers, Boston (2004).

[2] J. Meyer and G. W. Elko, "A highly scalable spherical microphone array based on an orthonormal decomposition of the soundfield," Proc of IEEE ICASSP, Orlando (2002).

[3] J. Meyer and G. W. Elko, "Audio system based on at least second-order eigenbeams," U.S. Pat. No. 7,587,054 (2009).

[4] J. Meyer and G. W. Elko, "Audio system based on at least second-order eigenbeams," U.S. Pat. No. 8,433,075 (2013).

[5] O. L. Frost, "An algorithm for linearly constrained adaptive processing," Proc. IEEE, vol. 60, no. 8, pp. 926-935, August 1972.

[6] S. Yan, H. Sun, U. P. Svensson, X. Ma, and J. M. Hovem, "Optimal modal beamforming for spherical microphone arrays," IEEE Trans. Audio, Speech, and Language Proc., Vol. 19, No. 2, pp. 361-371, February 2011.

[7] H. Sun, E. Mabande, K. Kowalczyk, and W. Kellermann, "Localization of distinct reflections in rooms using spherical microphones array eigenbeam processing," Jour. Acoust. Soc. Am., Vol. 131 (4), pp. 2828-2840, April 2012.

[8] Y. Peled and B. Rafaely, "Linearly-Constrained Minimum-Variance Method for Spherical Microphone Arrays Based on Plane-Wave Decomposition of the Sound Field," *IEEE Trans. Audio Speech Lang. Proc.*, Vol. 21(12), pp. 2532-2540, December 2013.

[9] T. J. Shan and T. Kailath, "Adaptive beamforming for coherent signals and interference," IEEE Trans. Acoust., Speech, Signal Processing, Vol. ASSP-33, pp. 527-536, June 1985.

[10] M. M. Sondhi and G. W. Elko, "Adaptive optimization of microphone arrays under a nonlinear constraint," in Proc. ICASSP, vol. 2, Tokyo, Japan, April 1986, pp. 981-984.

[11] J. Kivinen and M. K. Warmuth, "Exponentiated gradient versus gradient descent for linear predictors," Inform. Comput., vol. 132, pp. 1-64, January 1997.

[12] J. Benesty and Y. Huang, *Adaptive Signal Processing, Applications to Real-World Problems*, Springer, 2003, pp. 1-22.

[13] L. C. Biedenharn and J. D. Louck, *Angular Momentum in Quantum Physics*, Addison-Wesley, Reading, (1981).

Embodiments of the invention may be implemented as (analog, digital, or a hybrid of both analog and digital) circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing blocks in a software program. Such software may be employed in, for example, a digital signal processor, micro-controller, general-purpose computer, or other processor.

Embodiments of the invention can be manifest in the form of methods and apparatuses for practicing those methods. Embodiments of the invention can also be manifest in the form of program code embodied in tangible media, such as magnetic recording media, optical recording media, solid state memory, floppy diskettes, CD-ROMs, hard drives, or any other non-transitory machine-readable storage medium, wherein, when the program code is loaded into and executed by a machine, such as a computer, the machine becomes an apparatus for practicing the invention. Embodiments of the invention can also be manifest in the form of program code, for example, stored in a non-transitory machine-readable storage medium including being loaded into and/or executed by a machine, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits Any suitable processor-usable/readable or computer-usable/readable storage medium may be utilized. The storage medium may be (without limitation) an electronic, magnetic, optical, electromagnetic, infrared, or semiconductor system, apparatus, or device. A more-specific, non-exhaustive list of possible storage media include a magnetic tape, a portable computer diskette, a hard disk, a random access memory (RAM), a read-only memory (ROM), an erasable programmable read-only memory (EPROM) or Flash memory, a portable compact disc read-only memory (CD-ROM), an optical storage device, and a magnetic storage device. Note that the storage medium could even be paper or another suitable medium upon which the program is printed, since the program can be electronically captured via, for instance, optical scanning of the printing, then compiled, interpreted, or otherwise processed in a suitable manner including but not limited to optical character recognition, if necessary, and then stored in a processor or computer memory. In the context of this disclosure, a suitable storage medium may be any medium that can contain or store a program for use by or in connection with an instruction execution system, apparatus, or device.

The functions of the various elements shown in the figures, including any functional blocks labeled as "processors," may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those of ordinary skill in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A method for processing audio signals from an array of audio sensors, the method comprising:

(a) generating a plurality of eigenbeams from the audio signals;

(b) steering two or more of the eigenbeams to a specified direction;

(c) adaptively generating two or more weighting coefficients for the two or more eigenbeams based on first and second constraints, wherein the two or more weighting coefficients are required to satisfy the first constraint of having only non-negative values and the second constraint of summing to a specified value;

(d) respectively applying the two or more adaptively generated weighting coefficients to the two or more steered eigenbeams to generate two or more weighted, steered eigenbeams; and (e) combining the two or more weighted, steered eigenbeams to generate an output audio signal.

2. The method of claim 1, wherein:

step (a) comprises generating two or more zeroth-order eigenbeams and a plurality of non-zeroth-order eigenbeams from the audio signals;

step (b) comprises steering only two or more zeroth-order eigenbeams to the specified direction;

step (c) comprises adaptively generating the two or more weighting coefficients for the two or more zeroth-order eigenbeams;

step (d) comprises respectively applying the two or more adaptively generated weighting coefficients to the two or more steered, zeroth-order eigenbeams to generate two or more weighted, steered, zeroth-order eigenbeams; and step (e) comprises combining the two or more weighted, steered, zeroth-order eigenbeams to generate the output audio signal.

3. The method of claim 2, wherein step (b) comprises steering the two or more zeroth-order eigenbeams to the specified direction using the two or more zeroth-order eigenbeams and the plurality of non-zeroth-order eigenbeams.

4. The method of claim 1, wherein the specified value is one.

5. The method of claim 1, wherein step (b) further comprises applying a frequency correction to the two or more steered eigenbeams.

6. The method of claim 1, wherein:

the array of audio sensors is a three-dimensional spheroidal array of audio sensors; and the eigenbeams are spheroidal-harmonic eigenbeams.

7. The method of claim 6, wherein:

the three-dimensional spheroidal array of audio sensors is a spherical array of audio sensors; and the spheroidal-harmonic eigenbeams are spherical-harmonic eigenbeams.

8. The method of claim 1, wherein the array of audio sensors is a three-dimensional cylindrical array of audio sensors.

9. The method of claim 1, wherein the array of audio sensors is a two-dimensional elliptical array of audio sensors.

10. The method of claim 1, wherein the array of audio sensors is a one-dimensional linear array of audio sensors.

11. The method of claim 1, wherein step (c) comprises adaptively generating the two or more weighting coefficients using an exponentiated-gradient algorithm.

12. The method of claim 1, wherein step (c) comprises adaptively generating the two or more weighting coefficients using a least-mean-square algorithm.

13. The method of claim 1, wherein the two or more eigenbeams comprise eigenbeams of degrees zero, one, and two.

14. The method of claim 13, wherein the two or more eigenbeams further comprise at least one eigenbeam of degree three.

15. The method of claim 1, wherein:

the array of audio sensors is a three-dimensional spherical array of audio sensors;

step (a) comprises generating two or more zeroth-order spherical harmonic (SH) eigenbeams and a plurality of non-zeroth-order SH eigenbeams from the audio signals, wherein the two or more zeroth-order SH eigenbeams comprise zeroth-order SH eigenbeams of degrees zero, one, two, and three;

step (b) comprises steering only two or more zeroth-order SH eigenbeams to the specified direction using the two or more zeroth-order SH eigenbeams and the plurality of non-zeroth-order SH eigenbeams;

step (c) comprises adaptively generating the two or more weighting coefficients for the two or more zeroth-order SH eigenbeams;

step (d) comprises respectively applying the two or more adaptively generated weighting coefficients to the two or more steered, zeroth-order SH eigenbeams to generate two or more weighted, steered, zeroth-order SH eigenbeams;

step (e) comprises combining the two or more weighted, steered, zeroth-order SH eigenbeams to generate the output audio signal; and the specified value is one.

16. The method of claim 15, wherein:

step (b) further comprises applying a frequency correction to the steered, zeroth-order, SH eigenbeams; and step (c) comprises adaptively generating the two or more weighting coefficients using one of an exponentiated-gradient algorithm and a least-mean-square algorithm.

17. A method for processing original audio signals from an array of audio sensors, the method comprising:

(a) adding noise to the original audio signals to generate noise-added audio signals;

(b) generating a first plurality of eigenbeams from the noise-added audio signals;

(c) steering two or more eigenbeams of the first plurality of eigenbeams to a specified direction;

(d) adaptively generating two or more weighting coefficients for the two or more eigenbeams of the first plurality of eigenbeams based on first and second constraints, wherein the two or more weighting coefficients are required to satisfy the first constraint of having only non-negative values and the second constraint of summing to a specified value;

(e) generating a second plurality of eigenbeams from the original audio signals;

(f) steering two or more eigenbeams of the second plurality of eigenbeams to the specified direction;

(g) respectively applying the two or more adaptively generated weighting coefficients of step (d) to the two or more steered eigenbeams of step (f) to generate two or more weighted, steered eigenbeams; and (h) combining the two or more weighted, steered eigenbeams to generate an output audio signal.

18. An audio signal processing system comprising:

a modal decomposer configured to (a) generate a plurality of eigenbeams from audio signals from an array of audio sensors; and an adaptive modal beamformer configured to:

(b) steer two or more of the eigenbeams to a specified direction;

(c) adaptively generate two or more weighting coefficients for the two or more eigenbeams based on first and second constraints, wherein the two or more weighting coefficients are required to satisfy the first constraint of having only non-negative values and the second constraint of summing to a specified value;

(d) respectively apply the two or more adaptively generated weighting coefficients to the two or more steered eigenbeams to generate two or more weighted, steered eigenbeams; and (e) combine the two or more weighted, steered eigenbeams to generate an output audio signal.

19. The system of claim 18, further comprising the array of audio sensors.

20. The system of claim 18, wherein the adaptive modal beamformer is configured to:

(b) steer only two or more zeroth-order eigenbeams to the specified direction;

(c) adaptively generate the two or more weighting coefficients for the two or more zeroth-order eigenbeams;

(d) respectively apply the two or more adaptively generated weighting coefficients to the two or more steered, zeroth-order eigenbeams to generate two or more weighted, steered, zeroth-order eigenbeams; and (e) combine the two or more weighted, steered, zeroth-order eigenbeams to generate the output audio signal.

21. The method of claim 17, wherein:

step (f) comprises steering only two or more zeroth-order eigenbeams of the second plurality of eigenbeams to the specified direction; and step (g) comprises respectively applying the two or more adaptively generated weighting coefficients of step (d) to the two or more steered, zeroth-order eigenbeams of step (f) to generate two or more weighted, steered, zeroth-order eigenbeams; and step (h) comprises combining the two or more weighted, steered, zeroth-order eigenbeams to generate the output audio signal.

* * * * *